US010527039B2

(12) United States Patent
Lee et al.

(10) Patent No.: US 10,527,039 B2
(45) Date of Patent: Jan. 7, 2020

(54) SCROLL COMPRESSOR WITH DECOMPRESSION MEMBER

(71) Applicant: LG ELECTRONICS INC., Seoul (KR)

(72) Inventors: Jaesang Lee, Seoul (KR); Sanghun Seong, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 302 days.

(21) Appl. No.: 15/372,762

(22) Filed: Dec. 8, 2016

(65) Prior Publication Data

US 2017/0167485 A1 Jun. 15, 2017

(30) Foreign Application Priority Data

Dec. 9, 2015 (KR) ..... 10-2015-0175224

(51) Int. Cl.
*F04C 18/02* (2006.01)

(52) U.S. Cl.
CPC ..... *F04C 18/0253* (2013.01); *F04C 18/0215* (2013.01)

(58) Field of Classification Search
CPC ..... F04C 18/0253
See application file for complete search history.

(56) References Cited

U.S. PATENT DOCUMENTS 6,341,945 B1 1/2002 Hugenroth et al.
2003/0152473 A1* 8/2003 Ito ..... F04C 18/0253 418/55.6
2006/0065012 A1 3/2006 Kudo
(Continued)

FOREIGN PATENT DOCUMENTS

EP 2 554 844 2/2013
EP 2 693 056 2/2014
JP 2007-032511 2/2007
(Continued)

OTHER PUBLICATIONS

Machine Translation of JP 2007-032511 A, translated on Feb. 14, 2019. (Year: 2019).*
(Continued)

*Primary Examiner* — Mary Davis
(74) *Attorney, Agent, or Firm* — KED & Associates LLP

(57) ABSTRACT

A scroll compressor is provided that may include a communication hole that penetrates from a side surface of a non-orbiting scroll adjacent to a discharge side to a thrust bearing surface between the non-orbiting scroll and an orbiting scroll, and a decompression member having a radial sectional area smaller than a radial sectional area of the communication hole and inserted into the communication hole. A refrigerant discharged to a discharge space may be introduced to a suction space through the passage between the communication hole and the decompression member, thereby preventing a high vacuum state of a compression chamber, and a refrigerant passing through the communication hole may be decompressed during a normal operation to restrain leakage of the refrigerant to the thrust bearing surface between the non-orbiting scroll and the orbiting scroll, thus increasing compression efficiency.

16 Claims, 13 Drawing Sheets

(56) References Cited

U.S. PATENT DOCUMENTS

2011/0209448 A1* 9/2011 Watanabe ..... F04C 18/0253
55/431

FOREIGN PATENT DOCUMENTS

| | | |
|---|---|---|
| JP | 2010-101188 | 5/2010 |
| JP | 2010-163877 | 7/2010 |
| KR | 10-1300261 | 8/2013 |
| KR | 10-1510699 | 4/2015 |

OTHER PUBLICATIONS

International Search Report dated Mar. 15, 2017.
European Search Report dated Jul. 5, 2019.

* cited by examiner

SCROLL COMPRESSOR WITH DECOMPRESSION MEMBER

CROSS-REFERENCE TO RELATED APPLICATION(S)

Pursuant to 35 U.S.C. § 119(a), this application claims the benefit of earlier filing date and right of priority to Korean Application No. 10-2015-0175224, filed in Korea on Dec. 9, 2015, the contents of which is incorporated by reference herein in its entirety.

BACKGROUND

1. Field

A scroll compressor is disclosed herein.

2. Background

A scroll compressor is a compressor in which a non-orbiting scroll is installed in an internal space of a casing and an orbiting scroll is engaged with the non-orbiting scroll to make an orbiting motion to form a pair of two compression chambers, each including a suction chamber, an intermediate pressure chamber, and a discharge chamber between a non-orbiting wrap of the non-orbiting scroll and an orbiting wrap of the orbiting scroll. Scroll compressors, which smoothly perform suctioning, compressing, and discharging operations on a refrigerant to obtain a stable torque, while obtaining a high compression ratio, compared to other types of compressor, have been widely used for compressing a refrigerant in air-conditioners, and similar devices.

Scroll compressors may be classified as a low pressure type scroll compressor and a high pressure type scroll compressor depending on how a refrigerant is supplied to a compression chamber. In the low pressure type scroll compressor, a refrigerant is indirectly suctioned into a suction chamber through an internal space of a casing, and the internal space of the casing is divided into a suction space and a discharge space.

In contrast, in the high pressure type scroll compressor, a refrigerant is directly suctioned into a suction chamber, without passing through an internal space of a casing, and discharged through the internal space of the casing. In this type of scroll compressor, most of the internal space of the casing forms a discharge space.

Further, the scroll compressor may be classified as a tip seal type scroll compressor and a back pressure type scroll compressor depending on a sealing scheme of a compression chamber. In the tip seal type scroll compressor, a tip seal is installed on a front end of a wrap of each scroll, and when the compressor is operated, the tip seal floats to be tightly attached to a disk plate of an opposing scroll. In the back pressure type scroll compressor, a back pressure chamber is formed on a rear side of one scroll, oil or a refrigerant at an intermediate pressure is induced into the back pressure chamber to cause the scroll to be pressed by pressure of the back pressure chamber so as to be tightly attached to the opposing scroll. In general, the tip seal scheme is applied to the low pressure type scroll compressor, while the back pressure scheme is applied to the high pressure type scroll compressor. However, recently, an example in which the back pressure scheme is applied to the low pressure type scroll compressor has been introduced.

FIG. 1 is a vertical cross-sectional view illustrating an example of a related art low pressure and back pressure type scroll compressor. As illustrated, in the related art scroll compressor, a drive motor 20 generates a rotational force in an internal space 11 of an airtight casing 10, and a main frame 30 is installed or provided above the drive motor 20.

A non-orbiting scroll 40 is fixedly installed or provided on or at an upper surface of the main frame 30, and an orbiting scroll 50 is rotatably installed or provided with respect to the non-orbiting scroll 40 between the main frame 30 and the non-orbiting scroll 40. The orbiting scroll 50 is eccentrically coupled to a rotational shaft 25 coupled to a rotor 22 of the drive motor 20.

In the non-orbiting scroll 40, a fixed side hard plate part 41 is provided, the fixed side hard plate 41 having a disk shape. A side wall 42 that protrudes from an edge of the fixed side hard plate 41 is coupled to the main frame 30, the side wall 42 having an annular shape, and a non-orbiting wrap 43 forming a compression chamber P together with the orbiting wrap 52 (described hereinafter) are formed on an inner side of the side wall 42.

A suction opening 44 is formed on or at one side of the side wall 42, and a discharge opening 45 is formed in a vicinity of the center of the fixed side hard plate 41. A lower surface of the side wall 42 forms a second thrust bearing surface (hereinafter, referred to as a "second thrust surface") B2 together with an upper surface of the orbiting side hard plate 51.

In the orbiting scroll 50, an orbiting side hard plate 51 supported by the main frame 30, the orbiting side hard plate 51 having a disk shape, and the orbiting wrap 52 engaged with the non-orbiting wrap 43 of the non-orbiting scroll 40 to form the compression chamber P is formed on an upper surface of the orbiting side hard plate 51.

A boss 53 eccentrically coupled with the rotational shaft 25 is formed at a center of a lower surface of the orbiting side hard plate 51. An outer lower surface of the boss 53 is supported by an upper surface of the main frame 30 to form a first thrust bearing surface (hereinafter, referred to as "a first thrust surface") B1 together with the upper surface of the main frame 30. A back pressure chamber C is formed on the first thrust surface B1 between the orbiting scroll 50 and the main frame 30, and a back pressure hole 55 that guides a refrigerant at an intermediate pressure, a pressure between a suction pressure and a discharge pressure, from the intermediate pressure chamber of the compression chamber P to the back pressure chamber C, is formed in the orbiting side hard plate 51.

A low pressure separation plate 14 that separates the internal space 11 of the casing 10 into a suction space 12, a low pressure portion, and a discharge space 13, a high pressure portion, is coupled to an upper surface of the main frame 30. A suction pipe 15 is coupled to the suction space 12 and a discharge pipe 16 is coupled to the discharge space 13, in a communicating manner. Reference numeral 21 denotes a stator, 26 denotes a subframe, and 60 denotes an oldam ring.

In the related art scroll compressor as described above, when power is applied to the drive motor 20 to generate a rotational force, the rotational shaft 25 transfers the rotational force from the drive motor 20 to the orbiting scroll 50. Then, the orbiting scroll 50 performs an orbiting motion with respect to the non-orbiting scroll 40 by the oldam ring 60, forming a pair of two compression chambers P between the orbiting scroll 50 and the non-orbiting scroll 40 to suction, compress, and discharge a refrigerant. A portion of the refrigerant compressed in the compression chamber P moves from the intermediate pressure chamber to the back pressure chamber C through the back pressure hole 55, and the refrigerant at an intermediate pressure introduced to the back pressure chamber C generates a back pressure to cause the orbiting scroll 50 to float in a direction toward the non-orbiting scroll 40 to seal the second thrust surface B2 between the orbiting scroll 50 and the non-orbiting scroll 40.

During an operation of the compressor, an amount of refrigerant suctioned into the compression chamber P may be reduced as the suction side is blocked or for other reasons. In this case, pressure of the compression chamber P of the compressor may be lowered, putting the compressor in a high vacuum state.

When the compressor continuously operates in the high vacuum state, compression efficiency is lowered and the motor may be damaged. In consideration of this, in the related art, a high vacuum preventing device is provided within the compressor to bypass a portion of a refrigerant discharged to the discharge space to the suction space to resolve the high vacuum state.

As the related art high vacuum preventing device, a scheme of using a valve is largely known. FIGS. 1 and 2 illustrate an example of a scroll compressor having a high vacuum preventing device using a valve.

As illustrated, in the related art high vacuum preventing device 70, a communication flow channel 71 that connects the high pressure portion and the low pressure portion of the casing 10 is formed in the non-orbiting scroll 40, and a valve 72 that selectively opens and closes the communication flow channel 71 is installed or provided in a middle of the communication flow channel 71 and supported by a spring 73. One end of the communication flow channel 71 is connected to the intermediate pressure chamber by an intermediate pressure hole 74, and thus, the valve 72 is configured to open and close the communication flow channel 71, while moving according to a difference between a pressure of the intermediate pressure chamber and a spring force of the spring 73. Reference numeral 71*a* denotes a valve recess, 71*b* denotes a high pressure side flow channel, and 71*c* denotes a low pressure side flow channel.

Accordingly, when the compressor performs a normal operation, a pressure of the intermediate pressure chamber is so high that the valve 72 surpasses or pushes the spring 73, moving to a right side with respect to the drawing to block communication between the high pressure side flow channel 71*b* and the low pressure side flow channel 71*c*. When the compressor is operated in a high vacuum state, an intermediate pressure introduced to the valve recess 71*a* is so low that the valve 72 is moved in an opening direction (to a left side in the drawing) by the spring 73, and accordingly, the high pressure flow channel 71*b* and the low pressure flow channel 71*c* are connected to cause a high pressure refrigerant discharged to the discharge space 13 to be suctioned to the compression chamber P through the suction space 12, thus temporarily resolving the high vacuum state.

However, the scroll compressor having the related art high vacuum preventing device as described above has a large number of components forming the high vacuum preventing device, and thus, a large number of assembly processes, increasing manufacturing costs. Also, the related art high vacuum preventing device has a configuration in which the valve 72 moves according to a pressure difference to open or close the communication flow channel 71, and thus, time is required for opening and closing the communication flow channel 71 and resolving the high vacuum state of the compression chamber, causing a delay.

In addition, in the related art high vacuum preventing device, when a diameter of the communication flow channel 71 is large in consideration of processiblity, a high pressure refrigerant of the discharge space 13 is introduced to the suction space 12 through the communication flow channel 71, causing suction loss in the suction space 12. Also, while the compressor is normally operated, a high pressure refrigerant introduced through the communication flow channel 71 pushes the orbiting scroll 50 causing the orbiting scroll 50 to be unstable and the second thrust surface B2 to be opened and leak refrigerant, further lowering compression efficiency.

In addition, in the related art high vacuum preventing device, in a case in which a diameter of the communication flow channel 71 is reduced to lower a pressure of the refrigerant introduced from the discharge space to the suction space, it is difficult to process the communication flow channel 71. Also, as foreign objects may be trapped in and block the communication flow channel 71, the communication flow channel 71 may not function properly.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a scroll compressor according to an embodiment will be described on the basis of embodiments illustrated in the accompanying drawings.

Figure 1:
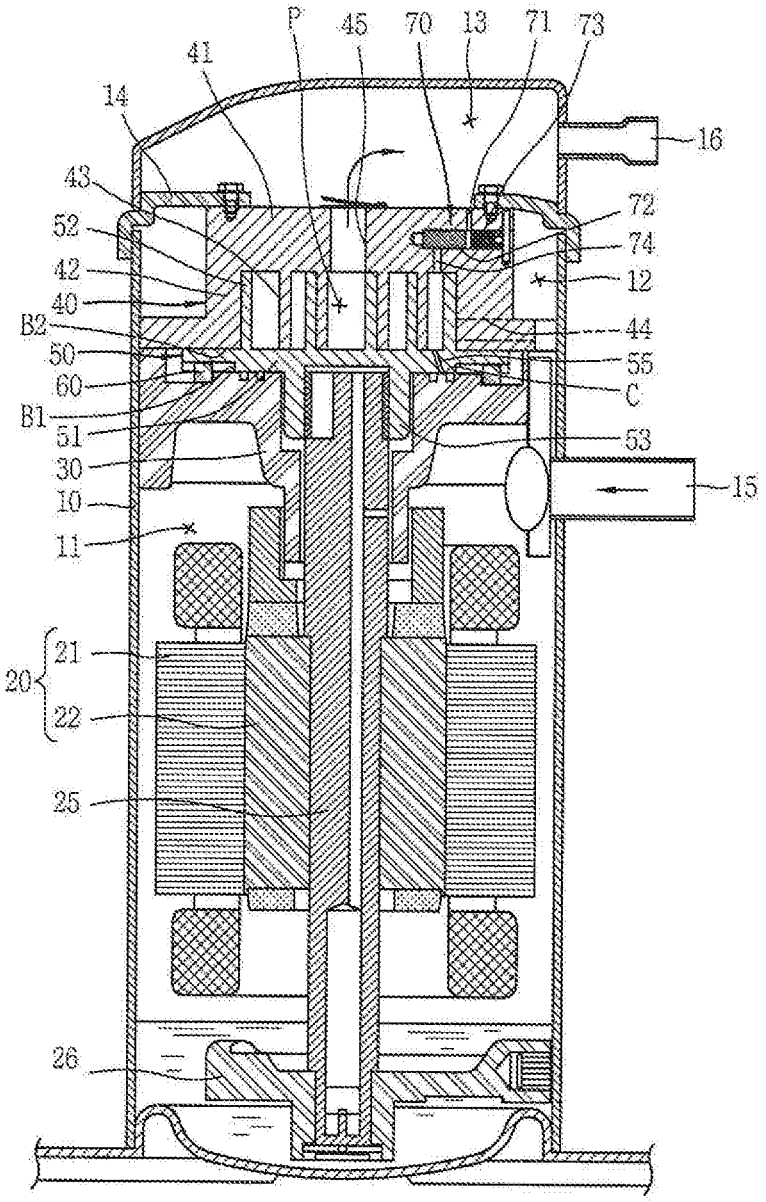
FIG. 1 RELATED ART
FIG. 1 is a vertical cross-sectional view of a low pressure and back pressure type related art scroll compressor.
Figure 2:
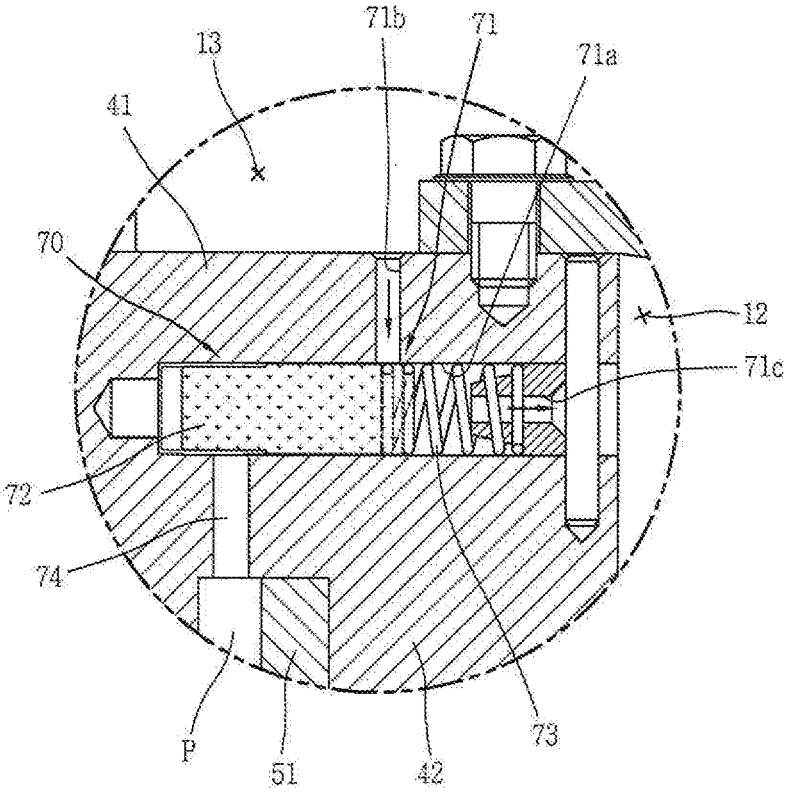
FIG. 2 RELATED ART
FIG. 2 is a vertical cross-sectional view illustrating a related art high vacuum preventing device using a valve in the scroll compressor of FIG. 1.
Figure 3:
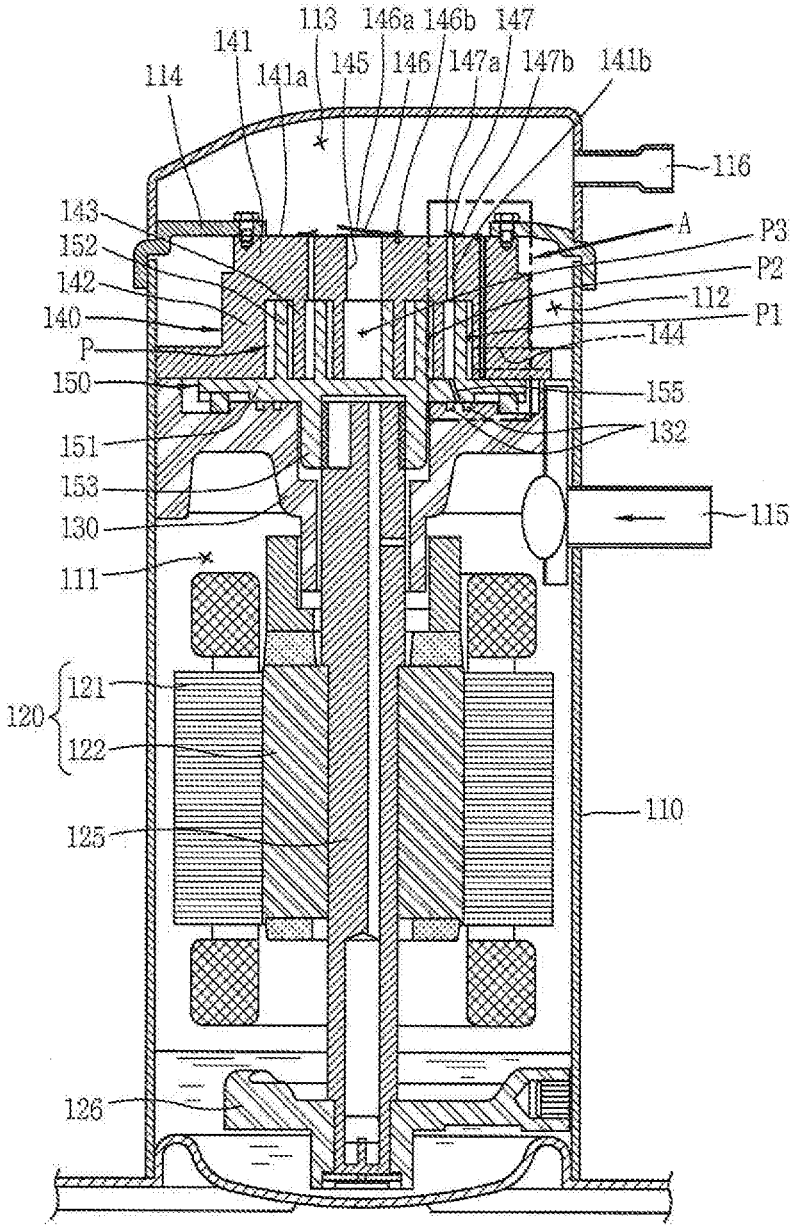
FIG. 3 is a vertical cross-sectional view of a scroll compressor according to an embodiment.
Figure 4:
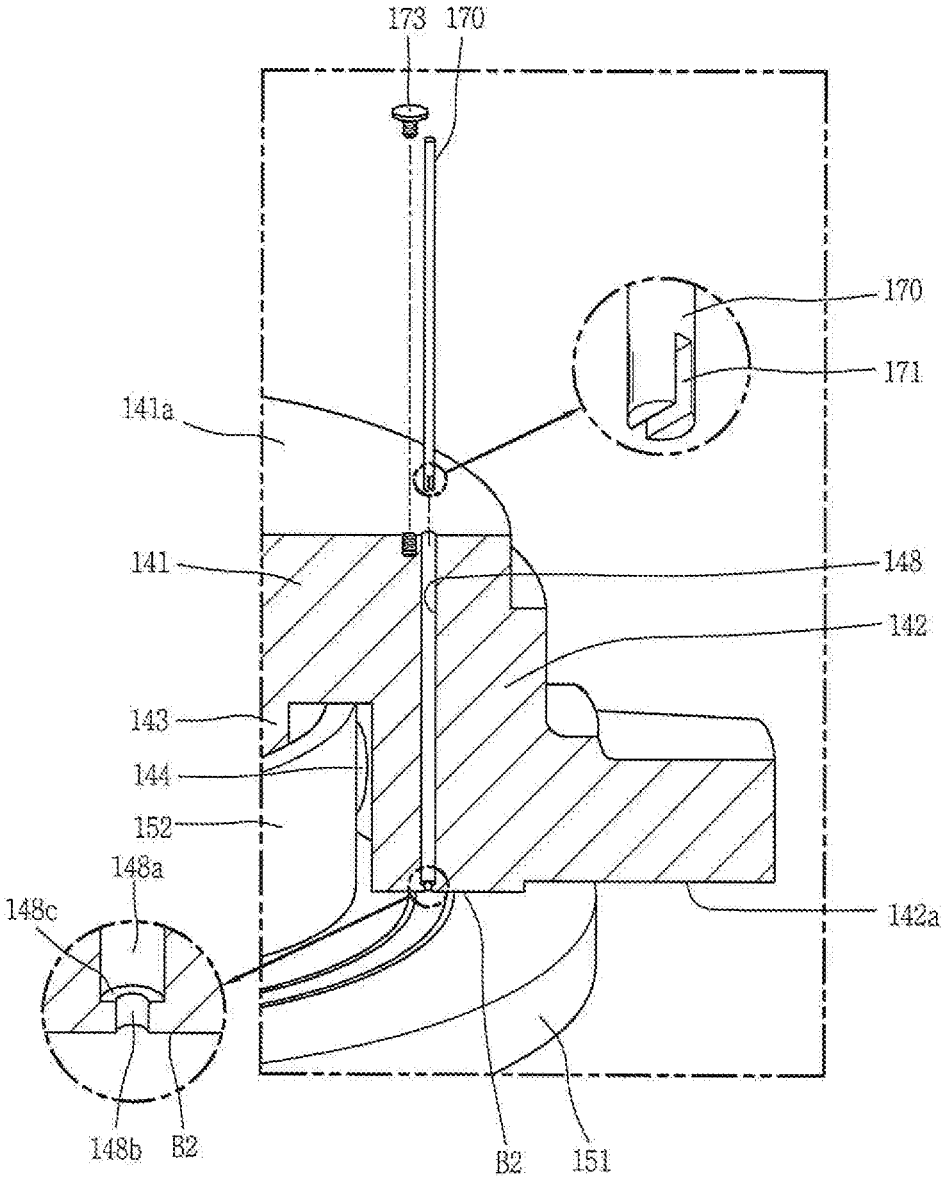
FIG. 4 is a partial cross-sectional view of a high vacuum preventing device of the scroll compressor of FIG. 3.
Figure 5:
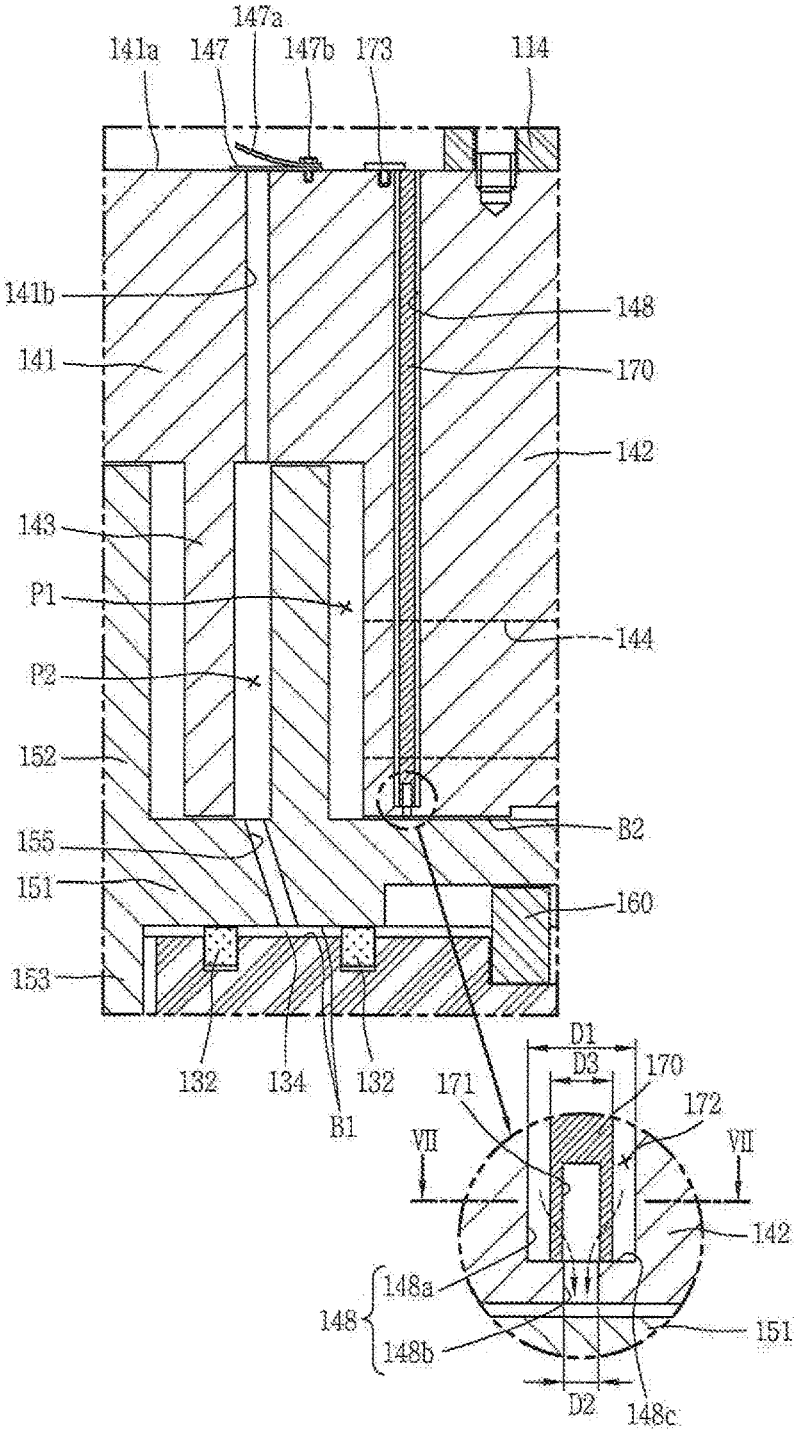
FIG. 5 is an enlarged vertical cross-sectional view illustrating a portion "A" in FIG. 3.
Figure 6:
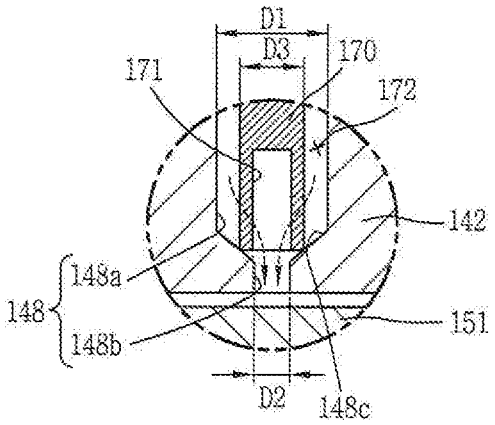
FIG. 6 is an enlarged vertical cross-sectional view illustrating a portion at which a first hole and a second hole are connected in FIG. 5.
Figure 7:
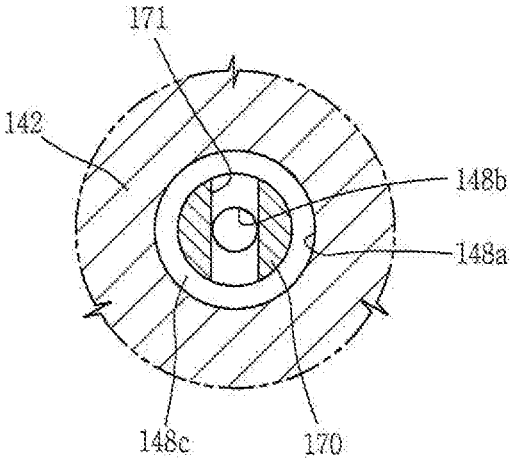
FIG. 7 is a cross-sectional view, taken along line VII-VII of FIG. 5.

FIG. 3 is a vertical cross-sectional view illustrating of a scroll compressor according to an embodiment. FIG. 4 is a partial cross-sectional view of a high vacuum preventing device of the scroll compressor of FIG. 3. FIG. 5 is an enlarged vertical cross-sectional view illustrating a portion "A" in FIG. 3. FIG. 6 is an enlarged vertical cross-sectional view of a portion at which a first hole and a second hole are connected in FIG. 5. FIG. 7 is a cross-sectional view, taken along line VII-VII of FIG. 5.

As illustrated, in a scroll compressor according to an embodiment, an internal space 111 of a casing 110 may be divided into a suction space 112 as a low pressure portion and a discharge space 113 as a high pressure portion by a high/low pressure separation plate 114. A suction pipe 115 may be coupled to the suction space 112, and a discharge pipe 116 may be coupled to the discharge pipe 116.

A central portion of the high/low pressure separation plate 114 may be coupled to an upper surface of a non-orbiting scroll 140 (described hereinafter), and an outer circumferential surface thereof may be airtightly coupled to an inner circumferential surface of the casing 110 to divide the internal space 111 of the casing 110 into the suction space 112 and the discharge space 113. Although not shown, a discharge plenum having a separate discharge space may be coupled to the non-orbiting scroll to divide the internal space of the casing into the suction space and the discharge space.

A drive motor 120 that generates a rotational force may be installed or provided in the suction space 112 of the casing 110, and a main frame 130 may be fixedly installed or provided above the drive motor 120. The non-orbiting scroll 140 may be installed or provided on an upper surface of a main frame 130, and an orbiting scroll 150 may be installed or provided to perform orbiting between the main frame 130 and the non-orbiting scroll 140.

The orbiting scroll 150 may be eccentrically coupled to a rotational shaft 125 coupled to a rotor 122 of the drive motor 120, and the orbiting scroll 150, while performing an orbiting motion, may form a pair of two compression chambers P including a suction chamber P1, an intermediate pressure chamber P2, and a discharge chamber P3, together with the non-orbiting scroll 140. Several intermediate pressure chambers may be continuously formed.

A first thrust bearing surface (hereinafter, referred to as a "first thrust surface") B1 may be formed between a first surface of the main frame 130 and surface of the orbiting scroll 140 corresponding thereto, and a second thrust bearing surface (hereinafter, referred to as a "second thrust surface") B2 may be formed between a first surface of the orbiting scroll 150 and a second surface of the non-orbiting scroll 140 corresponding thereto.

The non-orbiting scroll 140 may include a non-orbiting side hard plate 141, which may have a disk shape, and a side wall 142 supported by an upper surface of the main frame 130 and protruding in an annular shape from an edge of a lower surface of the non-orbiting side hard plate 141. A non-orbiting wrap 143 may be formed in an involute type, a logarithmic spiral, or other shape to form the compression chamber P together with an orbiting wrap 152 of the orbiting scroll 150.

A suction opening 144 may be formed on or at one side of the side wall 142 in a penetrating manner, such that the suction space 112 of the casing 110 may communicate with the compression chamber P. The suction opening 144 may have a circular shape or a extended hole shape, for example, and may communicate with the suction chamber P1.

A lower surface of the side wall 142 may be in contact with an edge of an orbiting side hard plate 151 to form the second thrust surface, that is, a sealing surface B2. A frictional contact avoiding surface 142*a* may be formed to be lower than the second thrust surface on or at an outer surface of the lower surface of the side wall 142, excluding the second thrust surface B2. A second hole 148*b* of a communication hole 148 (described hereinafter) may be formed on or in the second thrust surface B2 in order to restrain leakage of a refrigerant of the discharge space 113 to the suction space 112 during a normal operation.

A discharge opening 145 may be formed at a center of the non-orbiting side hard plate 141 such that the compression chamber P and the discharge space 113 of the casing 110 communicate with each other. In a vicinity of the discharge opening 145, a check valve 146 that prevents a refrigerant discharged to the discharge space 113 from flowing backwards to the discharge opening 145 may be installed or provided on or at a side surface 141*a* adjacent to the discharge space of the non-orbiting scroll 140. A bypass hole 141*b* that bypasses a portion of a refrigerant compressed in the compression chamber P may be formed in a vicinity of the check valve 146, and a bypass valve 147 that opens and closes the bypass hole 141 may be installed or provided in a vicinity of the bypass hole 141*b*.

The check valve 146 or the bypass valve 147 may be formed as a reed valve shape in a cantilever form, and may be fixedly coupled to the non-orbiting scroll 140 using bolts 146*b* and 147*b* together with retainers 146*a* and 147*a*. Thus, an end of a decompression member 170 (described hereinafter) adjacent to the discharge space 113 may be supported with respect to an axial direction by adjusting a length of the retainers 146*a* and 147*a* or a fastening position of the bolts 146*b* and 147*b*.

The orbiting stroll 150 may include the orbiting side hard plate 151 supported by the main frame 130 and having a disk shape, the orbiting wrap 152 engaged with the non-orbiting wrap 143 to form the compression chamber P may be formed on or at an upper surface of the orbiting side hard plate 151, and a boss 153 coupled to the rotational shaft 125 may be formed on or at a lower surface of the orbiting side hard plate 151. Accordingly, the orbiting scroll 150, in a state of being eccentrically coupled to the rotational shaft 125, may be engaged with the non-orbiting scroll 140 and makes an orbiting motion to form the pair of two compression chambers P each including the suction chamber P1, the intermediate pressure chamber P2, and the discharge chamber P3.

The non-orbiting scroll 140 may be fixedly coupled to the main frame 130 or may be coupled to the main frame 130 so as to be movable in the axial direction according to circumstances. For example, as illustrated in FIGS. 3 to 5, in a case in which a back pressure chamber 134 is formed on or at a rear side of the orbiting scroll 150, the non-orbiting scroll 140 may be fixed to the main frame 130, but in a case in which the back pressure chamber 140 is formed on or at a rear side of the non-orbiting scroll 140, the non-orbiting scroll 140 may be coupled to the main frame 130 so as to be movable in the axial direction. When the non-orbiting scroll 140 is fixed to the main frame 130, a plurality of sealing members or seals 132 may be provided on the first thrust surface B1 to form the back pressure chamber 134 and support the orbiting scroll 150, and a back pressure hole 155 that guides a refrigerant to the back pressure chamber 134 of the intermediate pressure chamber P2 may be formed in the orbiting side hard plate 151.

Reference numeral 121 denotes a stator, and 160 denotes an oldham ring.

In the scroll compressor according to the embodiment as described above, a refrigerant may be introduced into the suction space 112, a low pressure portion, through the suction pipe 114 from a refrigerating cycle. The low pressure refrigerant introduced to the suction space 112 may be introduced to the intermediate pressure chamber P2 through the suction opening 144 of the non-orbiting scroll 140 and the suction chamber P1, compressed, while moving to a, center between the orbiting scroll 150 and the non-orbiting scroll 140 according to an orbiting motion of the orbiting scroll 150, and discharged to the discharge space, 113 of the casing 110 from the discharge chamber P3 through the discharge opening 145 of the non-orbiting scroll 140, and the refrigerant may be discharged to a refrigerating cycle through the discharge pipe 116. This sequential process may be repeated.

A portion of the refrigerant compressed in the compression chamber P may be guided to the back pressure chamber 134 through the back pressure hole 155 from the intermediate pressure chamber P2, and the refrigerant guided to the back pressure chamber 134 may support the orbiting scroll 150 by a force based on the pressure such that the orbiting scroll 150 may be tightly attached to the non-orbiting scroll 140 to seal the compression chamber P in the axial direction. However, when the refrigerating cycle has an error or when a pump-down operation is performed, an amount of the refrigerant suctioned into the suction space 112 of the compressor may be significantly reduced, lowering a pressure of the compression chamber P or putting the compressor into a high vacuum state. When the pressure of the compression chamber P is lowered to a predetermined pressure or lower or when the compression chamber is in the high vacuum state, the pressure of the back pressure chamber 134 is lowered such that the orbiting scroll 150 cannot float, and when the orbiting scroll 150 does not float, a space between the non-orbiting scroll 140 and the orbiting scroll 150, that is, the second thrust surfaces B2, may open to further increasing leakage in the axial direction, significantly lowering compressor efficiency. In consideration of this, the communication hole 148 may be formed to connect the discharge space 113 and the suction space 112 when the pressure of the compression chamber P is lowered to a predetermined pressure or lower so the orbiting scroll 150 does not float.

However, if the communication hole 148 is formed to be too large, a behavior of the orbiting scroll 150 becomes unstable even during a normal operation or oil may be excessively introduced into the compression chamber P undesirably. If, however, the communication hole 148 is too small, it may be difficult to process the communication hole 148, degrading productivity.

Thus, in the this embodiment, the communication hole 148 may be formed to be sufficiently large to be processed and the decompression member 170 may be inserted into the communication hole 148 to reduce a radial sectional area of the communication hole 148 through which a refrigerant or oil may pass, whereby the refrigerant or oil may be effectively decompressed. Accordingly, as the high pressure refrigerant is introduced into the suction space 112, the low pressure portion, the communication hole 148 may be easily processed, while preventing degradation of efficiency of the compressor in advance, thereby enhancing productivity.

The communication hole 148 according to this embodiments may include a first hole 148*a* formed to have a predetermined depth from the side surface 141*a* of the discharge space side of the non-orbiting scroll 140 in the axial direction, and the second hole 148*b* extending from the first hole 148*a* and penetrating through the second thrust surface B2. An inner diameter D1 of the first hole 148*a* may be greater than an inner diameter D2 of the second hole 148*b*. Thus, the communication hole 148 according to this embodiment may be formed as a two-stage hole. Although not shown, the communication hole 148 may be formed as a multi-stage hole, in addition to the first hole 148*a* and the second hole 148*b*. In this case, an outer diameter of the decompression member 170 may be greater than the second hole 148*b*. Also, in this case, a decompression effect may be further enhanced as a refrigerant passes through the communication hole having multiple stages.

The communication hole 148 may also be formed as a single hole having a same inner diameter from the side surface 141*a* adjacent to the discharge space 113 of the non-orbiting scroll 140 to the second thrust surface B2; however, in this case, it may be difficult for the communication hole 148 to be formed as a small hole having a size, that is, from about 1 to 2 mm, required for reducing pressure. Thus, as in this embodiments, even though the second hole 148*b* is formed to be short, the communication hole 148 may include the first hole 148*a* and the second hole 148*b*.

As mentioned above, as the inner diameter D1 of the first hole 148*a* is formed to be greater than the inner diameter D2 of the second hole 148*b*, a connection surface 148*c* may be formed between the first hole 148*a* and the second hole 148*b*. Thus, when the decompression member 170, which may be bar-shaped, and have a predetermined diameter, is inserted into the first hole 148*a*, one end of the decompression member 170 may be installed or provided at the connection surface 148*c*.

As illustrated in FIG. 5, the connection surface 148*c* may be formed as a right angle surface between the first hole 148*a* and the second hole 148*b*. However, a diameter of the first hole 148*a* may be merely a few millimeters, and thus, it may be difficult to form the right angle surface through processing with a drill.

Thus, the connection surface 148*c* may be formed as a sloped surface, as illustrated in FIG. 6. When the connection surface 148*c* is formed as a sloped surface, the decompression member 170 may be mounted in or at a middle of the sloped surface. When the connection surface 148*c* is formed as a sloped surface, flow resistance between the first hole 148*a* and the second hole 148*b* may be reduced, and thus, a refrigerant may be rapidly moved through the communication hole 148. When the decompression member is inserted into the first hole 148*a*, the second hole 148*b* may be covered by the decompression member 170.

A communication recess 171 may be formed at one end of the decompression member 170, that is, at one end in contact with the connection surface 148*c*. Thus, although the inner diameter D2 of the second hole 148*b* is smaller than the diameter D3 of the decompression member 170 and the second hole 148*b* is covered by the decompression member 170, a refrigerant passing through the first hole 148*a* may smoothly flow to the second hole 148*b* through the communication hole 171.

Figure 8A:
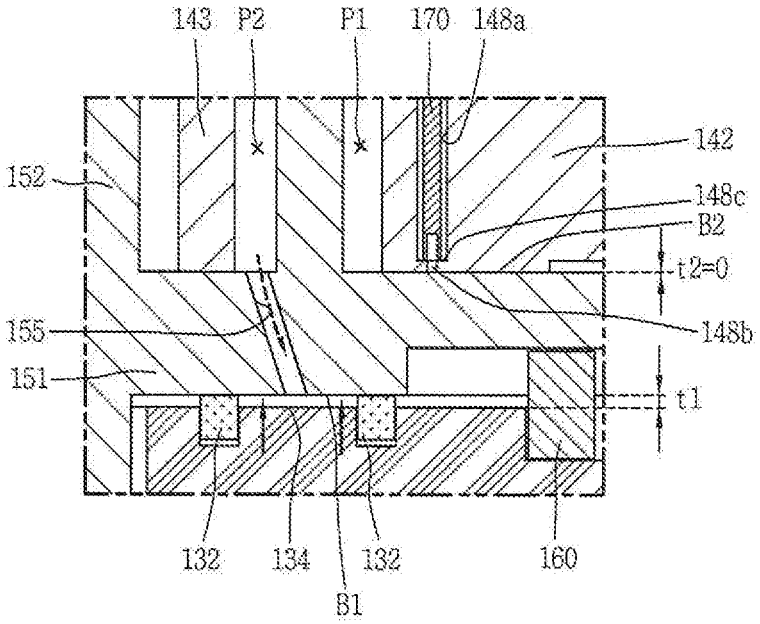
FIGS. 8A and 8B are vertical cross-sectional views illustrating a flow of a refrigerant when the scroll compressor of FIG. 3 normally operates and when the scroll compressor abnormally operates.
Figure 8B:
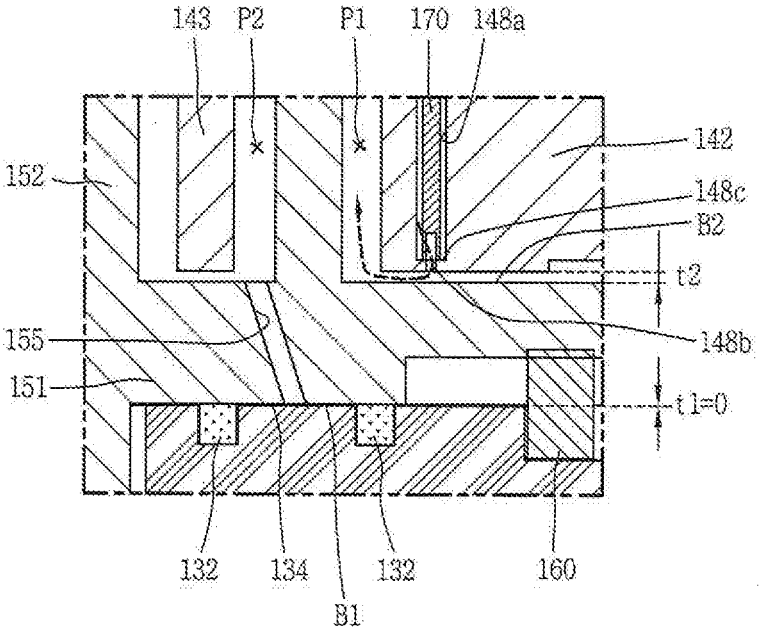

FIGS. 8A and 8B are vertical cross-sectional views illustrating a flow of a refrigerant on the second thrust surface when the scroll compressor according to this embodiment is normally operated and when the scroll compressor operates in a high vacuum state. As illustrated in FIG. 8A, when the compressor is normally operated, the orbiting scroll 150 may float toward the non-orbiting scroll 140 by the pressure of the back pressure chamber 134 and be tightly attached to the second thrust surface B2. Then, the second hole 148*b* of the communication hole 148 may be closed and the refrigerant of the discharge space 113 may be prevented from moving into the suction space 112.

As illustrated in FIG. 8B, in a case in which the compressor is in an abnormal operation state in which a suction pressure of a refrigerant is lowered and a suction amount of the refrigerant is reduced, an intermediate pressure may be lowered. Then, the pressure of the back pressure chamber 134 may be lowered, and the orbiting scroll 150 does not float and is separated from the non-orbiting scroll 140. Then, the second hole 148*b* of the communication hole 148 may be opened and the refrigerant of the discharge space 113 may move into the suction space 112. Then, the refrigerant moving into the suction space 112 may move into the compression chamber P through the suction opening 144, whereby the compression chamber P may be restrained from being highly vacuumized.

The refrigerant of the discharge space 113 may have a discharge pressure; however, the pressure may be lowered as the refrigerant having the discharge pressure passes through a narrow passage 172 between an inner circumferential surface of the communication hole 148 and an outer circumferential surface of the decompression member 170. Thus, as the refrigerant introduced to the suction space 112 is maintained at a significantly low pressure, compared with the discharge pressure, although the refrigerant is introduced to the compression chamber P, a suction loss may be minimized.

In a state in which the decompression member 170 is inserted into the communication hole 148, one end of the decompression member 170 adjacent to the discharge space 113 may be pressed by a support bolt 173 to fix the decompression member 170. As illustrated in FIG. 5, the support bolt 173 may be fastened to the non-orbiting side hard plate 141 of the non-orbiting scroll 140 to thus support one end of the decompression member 170, which may be supported by a head portion or head of the support bolt 173.

Figure 9:
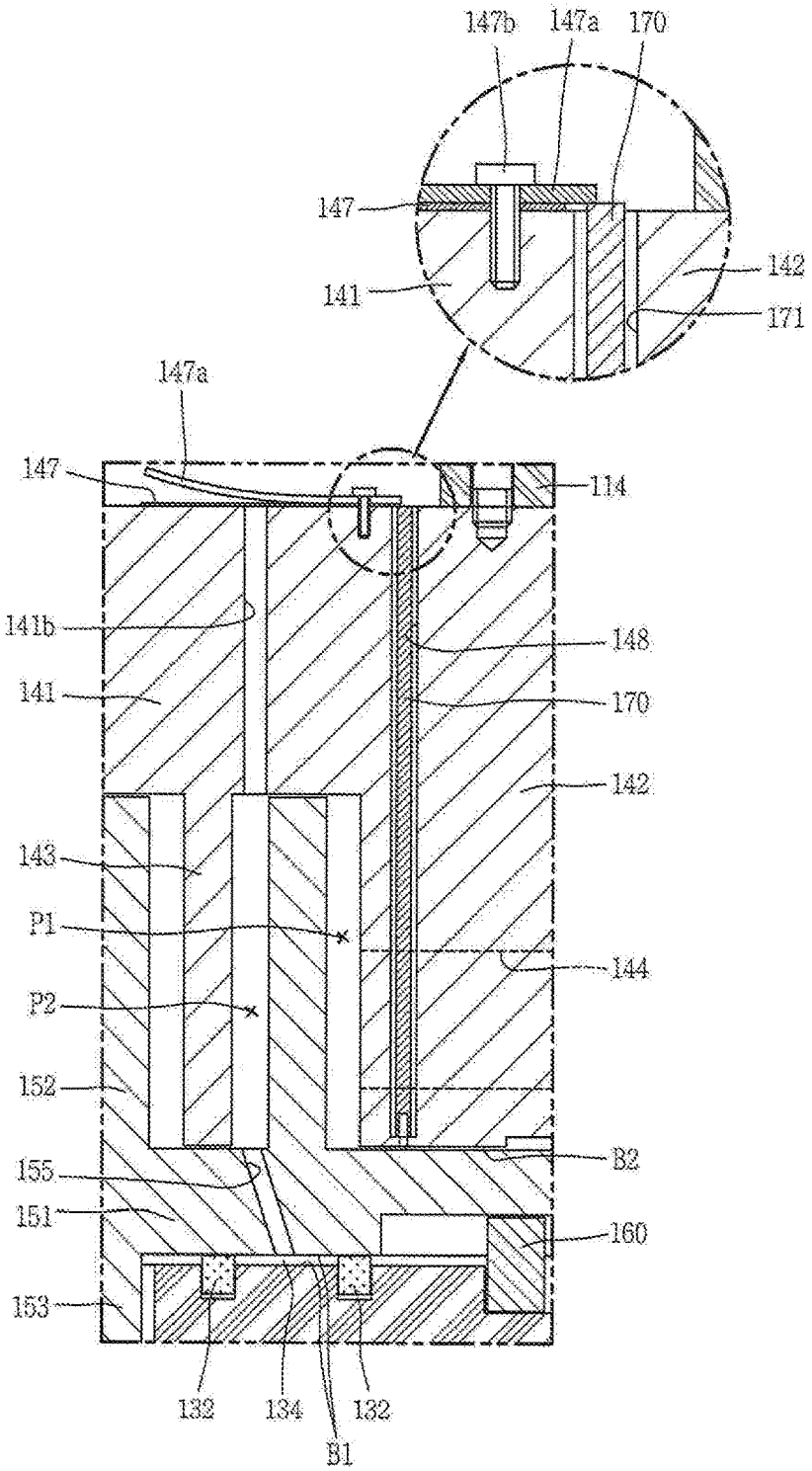
FIG. 9 is a vertical cross-sectional view of a method for fixing a decompression member in the high vacuum preventing device of FIG. 3 according to an embodiment.

Also, one end of the decompression member 170 adjacent to the discharge side 113 may be supported using an accessory of the check valve 146 preventing a back flow of the discharged refrigerant or a bypass valve 147 that selectively bypasses the refrigerant at an intermediate pressure. For example, the decompression member 170 may be supported using a head portion or head of the bolt 147*b* that fastens the bypass valve 147, or as illustrated in FIG. 9, a discharge side end of the decompression member 170 may be supported by the retainer 147*a* by extending the retainer 147*a* limiting an opening amount of the bypass valve 147. Alternatively, rather than being fixed using a separate member, the decompression member 170 may be press-fit and fixed to the communication hole 148 or may include a thread to allow it to be screw-fastened.

Figure 10:
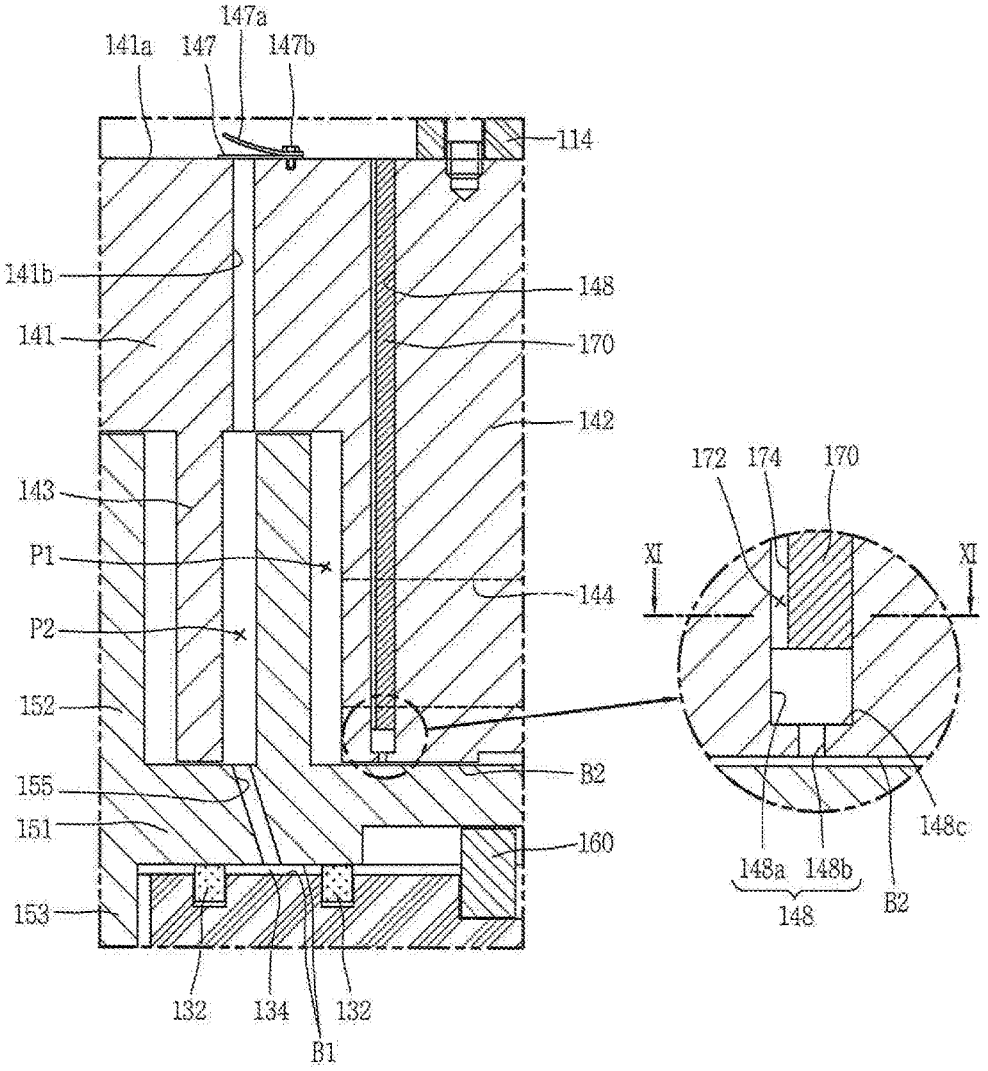
FIG. 10 is a vertical cross-sectional view of a decompression member in a high vacuum preventing device according to another embodiment.
Figure 11:
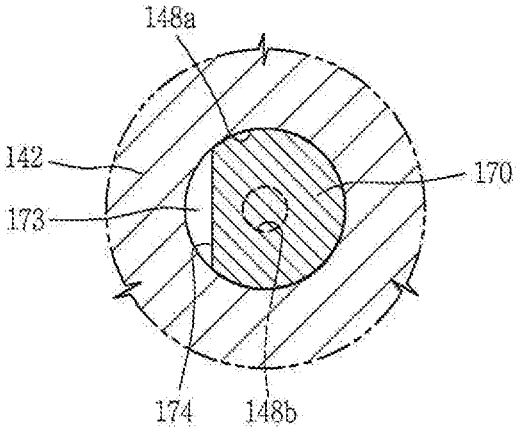
FIG. 11 is a cross-sectional view, taken along line XI-XI of FIG. 10.

In this case, as illustrated in FIGS. 10 and 11, at least one communication surface 174 having a D-cut shape may be formed on or at the outer circumferential surface of the decompression member 170 to form the passage 172 allowing refrigerant to move between the inner circumferential surface of the communication hole 148 and the communication surface 174. The communication surface 174 may be formed as a linear surface or to having a spiral shape in a lengthwise direction between both ends of the outer circumferential surface of the decompression member 170.

Although not shown, the decompression member 170 may have a shape with a circular cross-section and the communication hole 148 may be formed to have an angular shape or a shape in which a plurality of circles partially overlap each other to form the passage 172 between the communication hole 148 and the decompression member 170. Accordingly, as a separate communication surface is not required to be formed on a surface of the decompression member 170, the decompression member 170 may be easily formed. Also, the communication hole 148 may have a circular shape and the decompression member 170 may have an angular shape.

The decompression member 170 may not be fixed to the communication hole 148. In this case, as the outer diameter of the decompression member 170 is smaller than the inner diameter of the communication hole 148, the decompression member 170 may be moved by a pressure difference or vibration of the compressor within the communication hole 148; however, a space between the decompression member 170 and the communication hole 148 is small and a portion of oil discharged to the discharge space 113 may be introduced into the passage 172 between the decompression member 170 and the communication hole 148 to restrain movement of the decompression member 170. When an abnormal condition occurs while the compressor is being transported or operated, the decompression member 170 may be released or cause noise in the compressor during operation. Thus, the decompression member 170 may be fixed to the communication hole 148 using the aforementioned embodiment, for example.

A decompression effect of the communication hole 148 may be defined by a relational expression regarding a length of the communication hole 148 and a radial sectional area of the passage 172. That is, the decompression effect may be enhanced as the communication hole 148 is longer and as the radial sectional area of the passage 172 is smaller.

In particular, considering the decomposition effect, a decompression effect for a same area may be higher when the passage 172 is formed on or along an entire outer circumferential surface of the decompression member 170, as illustrated in FIG. 5, than when the passage 172 is formed only on or at one side of the outer circumferential surface of the decompression member 170, as illustrated in FIG. 10. That is, when the passage 172 is formed on or at one side of the outer circumferential surface of the decompression member 170, as illustrated in FIG. 11, a vertical diameter may be increased to reduce flow resistance, degrading a decompression effect, compared with a case in which the passage 172 is formed on the entire outer circumferential surface of the decompression member 170, as illustrated in FIG. 7. Thus, when the area of the passage is the same, the passage may be formed to be evenly distributed along the outer circumferential surface of the decompression member.

Another embodiment of the communication hole will be described hereinafter.

Figure 12:
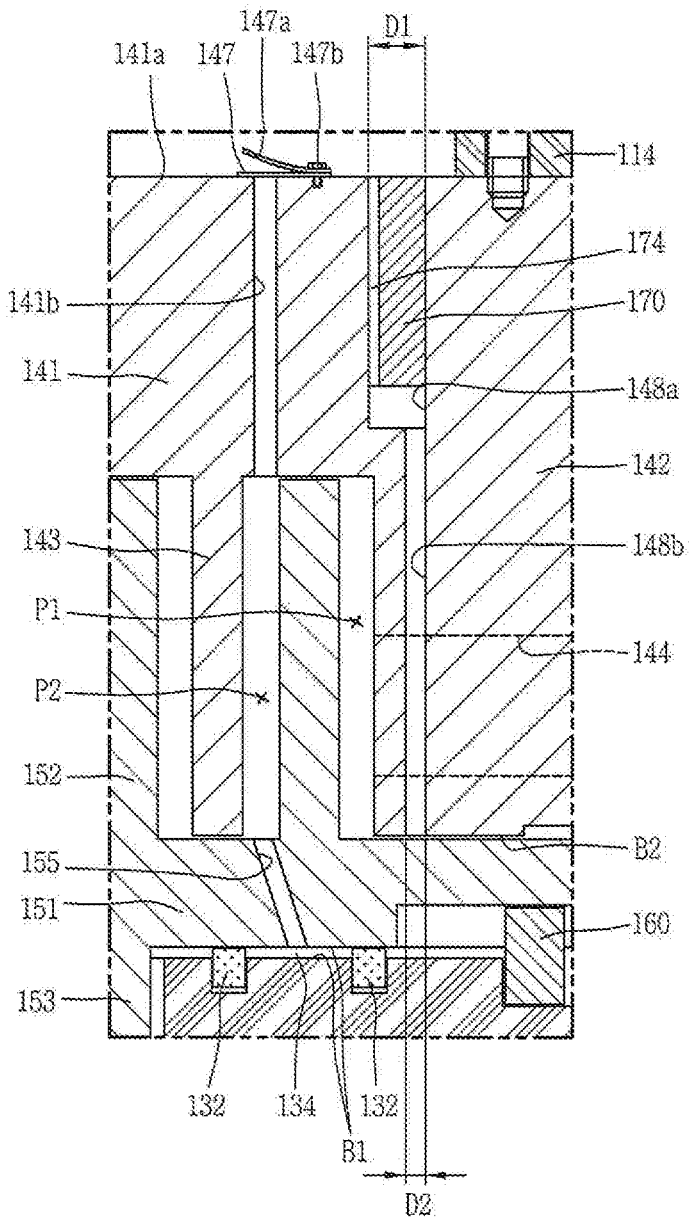
FIG. 12 is a vertical cross-sectional view of a communication hole in a high vacuum preventing device according to another embodiment.

That is, the first hole 148*a* and the second hole 148*b* may be formed to be concentric as described above, however, according to circumstances, the first hole 148*a* and the second hole 148*b* may be formed to have different central axes or central longitudinal axes. For example, as illustrated in FIG. 12, in a case in which an outer diameter of the non-orbiting side hard plate 141 of the non-orbiting scroll 140 is positioned on or at an inner side of an outermost portion of the non-orbiting wrap 143 or in a case in which there is not much space in or at an edge of at least the non-orbiting side hard plate 141, that is, in a case in which a space for forming a communication hole is not sufficient, the first hole 148*a* may be formed at a center side of the non-orbiting scroll 140, relative to the second hole 148*b* and the second hole 148*b* may be positioned on or at an outer side and partially overlap a portion of the first hole 148*a*. Thus, the first hole 148*a* may have a length that does not overlap the compression chamber P in a radial direction.

Also, in this case, the first hole 148*a* and the second hole 148*b* may be a same diameter, or the diameter D2 of the second hole 148*b* may be smaller than the diameter D1 of the first hole 148*a*. However, as an overlap area between the first hole 148*a* and the second hole 148*b* is smaller than the inner diameter D1 of the first hole 148*a*, when the decompression member 170 is inserted into the first hole 148*a*, the second hole 148*b* may be covered. Thus, also, in this case, a communication recess may be formed at an end portion of the decompression member 170 and fixed to the connection surface 148*c* between the first hole 148*a* and the second hole 148*b*, or the communication surface 174 may be cut to have a D-cut shape on the outer circumferential surface of the decompression member 170 and press-fit to the first hole 148*a*, as illustrated in FIG. 12. Thus, the communication hole 148, in particular, the first hole 148*a*, may have a diameter sufficient to facilitate processing and an area of the communication hole 148 may be appropriately adjusted using the decompression member 170.

Accordingly, a phenomenon that a behavior of the orbiting scroll is unstable due to a refrigerant introduced into the communication hole to open the second thrust surfaces when the compressor performs a normal operation may be suppressed. Further, as the device provided between the discharge space, that is, the high pressure portion, and the suction space, that is, the low pressure portion, to prevent a high vacuum state of the low pressure portion is simplified, manufacturing cost may be reduced.

Furthermore, as the refrigerant is rapidly moved from the high pressure portion to the low pressure portion, a high vacuum state of the compression chamber may be rapidly released. Also, as the refrigerant introduced from the high pressure portion to the low pressure portion is decompressed to an appropriate pressure through the communication hole, generation of a suction loss at the low pressure portion may be restrained to increase compressor efficiency.

Additionally, oil may be contained in the refrigerant discharged from the compression chamber. The refrigerant may be separated from the oil in the discharge space 113 and discharged to the refrigeration cycle and the oil separated from the refrigerant may remain in the discharge space 113. When an amount of the remaining oil is increased, an oil shortage may occur in an entire refrigeration cycle, degrading a freezing capability, and an oil shortage may also occur within the compressor, significantly degrading lubrication performance.

However, when the communication hole 148 is formed as in this embodiment, oil may flow to the second thrust surface B2 through the communication hole 148 little by little, and in particular, when the pressure of the suction space 112 is rapidly lowered, oil may be bypassed to the suction space 112 together with the refrigerant to resolve the oil shortage in the entire refrigeration cycle including the compressor. In this case, oil may be decompressed, while passing through the passage 172 between the narrow communication hole 148 and the decompression member 170, thus reducing suction loss. The second hole 148*b* as an outlet of the communication hole 148 may be formed adjacent to the suction opening 144 or the suction chamber P1 in order to allow the refrigerant and oil introduced to the second thrust surface to be rapidly moved to the suction chamber P1.

Figure 13:
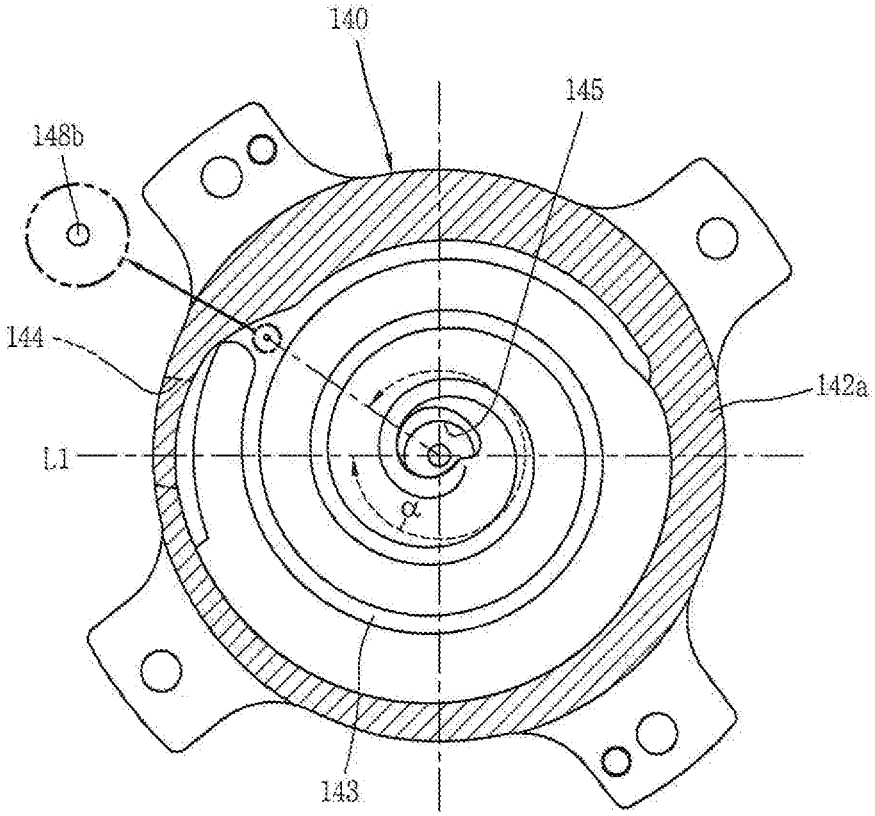
FIG. 13 is a bottom view of a non-orbiting scroll illustrating a position of a communication hole according to an embodiment.

FIG. 13 is a bottom view of a non-orbiting scroll illustrating a position of a communication hole according to an embodiment. As illustrated, the suction opening 144 may be formed on one surface of the non-orbiting scroll 140 in a penetrating manner, and an outer compression pocket may not be formed, starting from the suction opening 144 to a predetermined crank angle (substantially, 180° with respect to a central line L1 of the suction opening). Thus, a lower surface of the non-orbiting scroll 140 to this point does not form a thrust bearing surface (second thrust surface) and an abrasion avoiding surface (the shaded portion) 142*a* may be formed to be stepped. Thus, a crank angle (a) at which the second hole 148*b* of the communication hole 148 is formed may be formed substantially within 270° along a trace of the wrap with respect to the central line L1 of a portion at which the second thrust surface B2, that is, the suction opening 144 is located.

Another embodiment of the scroll compressor according to an embodiment will be described hereinafter.

Figure 14:
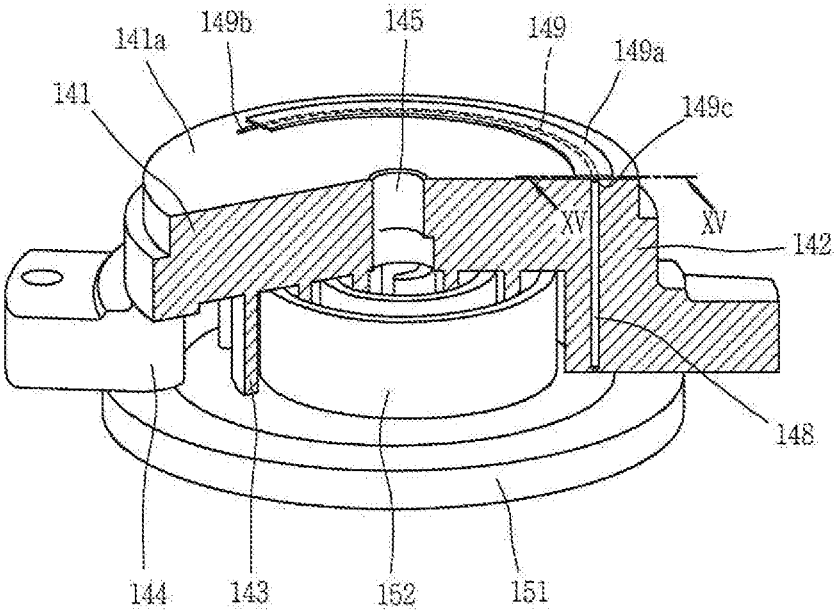
FIG. 14 is a perspective view according of a high vacuum preventing device according to another embodiment.
Figure 15:
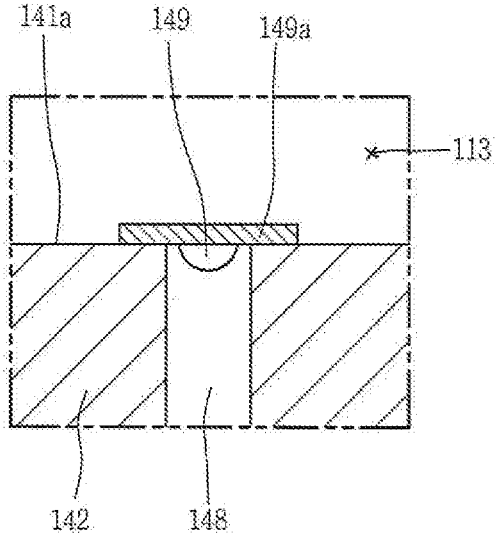
FIG. 15 is a cross-sectional view, taken along line XV-XV of FIG. 14.

That is, in the previous embodiment, the decompression member is inserted into the communication hole 148 to decompress the refrigerant or oil in the communication hole 148, but in this embodiment, an extending recess 149 may be formed on the side surface 141*a* of the non-orbiting scroll 140 adjacent to the discharge space to reduce a pressure in the extending recess 149. For example, as illustrated in FIGS. 14 and 15, the extending recess 149 may be formed to have a circular arc shape on the side surface 141*a* of the non-orbiting scroll 140 adjacent to the discharge space. Thus, one or a first end 149*c* of the extending recess 149 may be connected to the communication hole 148 and the other or a second end 149*b* may be separated from the communication hole 148.

A cover member or cover 149*a* that covers the extending recess 149 may be coupled to the side surface 141*a* of the non-orbiting scroll 140 adjacent to the discharge space. The cover 149*a* may cover a portion at which the extending recess 149 and the communication hole 148 communicate with each other, but open the second end 149*b* of the extending recess 149 to communicate with the discharge space 113 to allow the refrigerant to be introduced from the discharge space 113 to the extending recess 149.

The extending recess 149 may also have an annular shape. In this case, the second end 149*b* may be formed such that at least any one side of the extending recess 149, excluding the portion communicating with the communication hole 148, communicates with the discharge space 113.

A basic configuration and operational effect of the scroll compressor according to the embodiment described above may be similar to or the same as those of the previous embodiment. However, in this embodiment, a decompression member may be installed or provided in the communication hole 148, but as pressure is reduced in the extending recess 149, the decompression member may not be required to be installed in the communication hole 148. Also, in this embodiment, as the extending recess 149 is formed to be smaller than a radial sectional area of the communication hole 148, the communication hole 148, which is difficult to manufacture, has a relatively large radial sectional area to increasing processibility, while the extending recess 149, which is easy to manufacture, has a small radial sectional area, and thus, processibility may be enhanced.

Embodiments disclosed herein provide a scroll compressor in which a device provided between a high pressure part or portion and a low pressure part or portion to prevent a high vacuum state of the lower pressure part is simplified, reducing manufacturing costs. Embodiments disclosed herein further provide a scroll compressor in which a high vacuum preventing device is provided between a high pressure part or portion and a low pressure part or portion so that a refrigerant may be rapidly moved from the high pressure part to the low pressure part.

Embodiments disclosed herein provide a scroll compressor in which a refrigerant introduced from a high pressure part or portion to a low pressure part or portion is decompressed to an appropriate pressure and introduced to the low pressure part, thereby reducing suction loss of the compressor and increasing compression efficiency. Embodiments disclosed herein provide a scroll compressor in which a flow channel that guides a refrigerant from a high pressure part or portion to a low pressure part or portion is formed to have a size such that it may be easily processed, while preventing foreign objects from being trapped. Embodiments disclosed herein also provide a scroll compressor in which a flow channel that guides a refrigerant from a high pressure part or portion to a low pressure part or portion is formed to have a size such that it may be easily processed, while a refrigerant of the high pressure part is decompressed and guided to the low pressure part.

Embodiments disclosed herein provide a scroll compressor that may include a casing in which an internal space is divided into a suction space and a discharge space; a main frame coupled to the casing; a non-orbiting scroll coupled to the main frame and having a discharge space side surface included in the discharge space (or having a surface forming the discharge space); an orbiting scroll supported by the main frame in a thrust direction and having one or a first surface forming a first thrust bearing surface together with the main frame and the other or a second surface forming a second thrust bearing surface together with the non-orbiting scroll, and engaged with the non-orbiting scroll to form a compression chamber; a communication hole formed to penetrate from the discharge space side surface of the non-orbiting scroll to the second thrust bearing surface; and a decompression member inserted into the communication hole. A radial sectional area of the decompression member may be smaller than a sectional area of the communication hole in a radial direction to form a passage between an outer circumferential surface of the decompression member and an inner circumferential surface of the communication hole.

The decompression member may have a communication recess formed at one end adjacent to the second thrust bearing surface. At least one communication surface may be formed on an outer circumferential surface of the decompression member between both ends of the decompression member.

The communication hole may include a first hole having a first inner diameter from the discharge space side surface to a predetermined depth, and a second hole that communicates with the first hole, penetrating up to the second thrust bearing surface, and having a second inner diameter. An inner diameter of the second hole may be smaller than an outer diameter of the decompression member.

An inner diameter of the first hole may be larger than an inner diameter of the second hole to form a connection surface between the first hole and the second hole. One end of the decompression member may be supported by the connection surface. The decompression member may have a communication recess formed at an end portion or end in contact with the connection surface to allow the first hole and the second hole to communicate with each other.

The decompression member may be formed to be smaller than an inner diameter of the communication hole. A discharge space side end portion or end of the decompression member may be supported by a member provided on the discharge space side surface of the non-orbiting scroll in an axial direction.

A valve may be installed or provided on or at the discharge space side surface of the non-orbiting scroll. At least a portion of the valve or a member that supports the valve may be installed or provided to overlap a discharge space side end of the decompression member in an axial direction.

A portion of an outer circumferential surface of the decompression member may be tightly attached and fixed to an inner circumferential surface of the communication hole, and a communication surface may be formed at at least one of the inner circumferential surface of the communication hole or the outer circumferential surface of the decompression member to separate a portion of the inner circumferential surface of the communication hole and a portion of the outer circumferential surface of the decompression member. The decompression member may be formed to have a length such that at least a portion thereof overlaps the compression chamber in a radial direction.

The decompression member may be positioned on or at an outer side with respect to the compression chamber in an axial direction. The first hole and the second hole may be formed such that central lines or central longitudinal axes thereof in an axial direction are different.

One end of the communication hole formed on the second thrust bearing surface may be formed on or at an outer side, relative to an outermost compression chamber. An extending recess communicating with the communication hole may be formed on or at a high pressure part side surface of the non-orbiting scroll and have a predetermined length, and a cover member that covers a portion of the extending recess including a portion where the extending recess and the communication hole are connected may be coupled to the high pressure part side surface of the non-orbiting scroll.

Embodiments disclosed herein provide a scroll compressor that may include a casing in which an internal space is divided into a suction space and a discharge space; a main frame coupled to the casing; a non-orbiting scroll coupled to the main frame and having a discharge space side surface included in the discharge space; an orbiting scroll supported by the main frame in a thrust direction and having one or a first surface forming a first thrust bearing surface together with the main frame and the other or a second surface forming a second thrust bearing surface together with the non-orbiting scroll, and engaged with the non-orbiting scroll to form a compression chamber; a communication hole formed to penetrate from the discharge space side surface of the non-orbiting scroll to the second thrust bearing surface; an extending recess that extends to have a predetermined length and sectional area on the discharge space side surface of the non-orbiting scroll to communicate with the communication hole; and a cover member that covers a portion of the extending recess including a portion where the extending recess and the communication hole are connected. A radial sectional area of the extending recess may be smaller than or equal to a radial sectional area of the communication hole.

As described above, in the scroll compressor according to embodiments, a communication hole may be formed to penetrate from the discharge space side surface of the non-orbiting scroll to the thrust bearing surface between the non-orbiting scroll and the orbiting scroll, and the decompression member having a radial sectional area smaller than that of the communication hole may be inserted into the communication hole, whereby when a pressure of the compression chamber is rapidly lowered, a refrigerant discharged to the discharge space may be introduced to the suction space through the passage between the communication hole and the decompression member, thereby preventing a high vacuum state of the compression chamber. Further, as the configuration of the device for preventing a high vacuum state is simplified, manufacturing costs may be reduced, and when the compressor is operated in a high vacuum state, a refrigerant of the discharge space may be rapidly moved to the suction space to resolve the high vacuum state. Furthermore, as the high pressure refrigerant discharged to the discharge space is decompressed to an appropriate pressure, while passing through a narrow passage between the communication hole and the decompression member, a suction loss in the suction space may be restrained.

In addition, a pressure of the refrigerant applied to the orbiting scroll through the communication hole even during a normal operation is lowered to prevent an unstable behavior of the orbiting scroll, whereby leakage in the compression chamber in an axial direction may be restrained. As the passage between the communication hole and the decompression member is formed to be large to lengthen a decompression flow channel, foreign objects may be prevented from being trapped. When a high vacuum state is caused during an operation of the compressor, the refrigerant of the discharge space may be introduced to the compression chamber through the communication hole to prevent the high vacuum state, whereby when the compressor is stopped, the thrust bearing surface between the non-orbiting scroll and the orbiting scroll may be opened and the refrigerant of the discharge space may be moved to the suction space through the communication hole to equalize the pressure, and thus, a normal operation may be rapidly performed at a time of restarting, enhancing compressor performance.

The embodiments disclosed herein and advantages are merely exemplary and are not to be considered as limiting. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of embodiments described herein may be combined in various ways to obtain additional and/or alternative exemplary embodiments.

Further scope of applicability of the present application will become more apparent from the detailed description given hereinafter. However, it should be understood that the detailed description and specific examples, while indicating embodiments, are given by way of illustration only, since various changes and modifications within the scope will become apparent to those skilled in the art from the detailed description.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing, an internal space of which is divided into a suction space and a discharge space;

a main frame coupled to the casing;

a non-orbiting scroll coupled to the main frame and having a discharge space side surface included in the discharge space;

an orbiting scroll supported by the main frame in a thrust direction and having a first surface forming a first thrust bearing surface together with the main frame and a second surface forming a second thrust bearing surface together with the non-orbiting scroll, the orbiting scroll being engaged with the non-orbiting scroll to form a compression chamber;

a communication hole that penetrates from the discharge space side surface of the non-orbiting scroll to the second thrust bearing surface; and a decompression member inserted into the communication hole, wherein the decompression member includes a communication recess formed at an end of the decompression member adjacent to the second thrust bearing surface, wherein an outer diameter of the decompression member is smaller than an inner diameter of the communication hole, and wherein a discharge space side end of the decompression member is supported by a support bolt provided on the discharge space side surface of the non-orbiting scroll in an axial direction.

2. The scroll compressor of claim 1, wherein a radial sectional area of the decompression member is smaller than a radial sectional area of the communication hole to form a passage between an outer circumferential surface of the decompression member and an inner circumferential surface of the communication hole.

3. The scroll compressor of claim 1, wherein at least one communication surface is formed on an outer circumferential surface of the decompression member between both ends of the decompression member.

4. The scroll compressor of claim 1, wherein the communication hole includes:

a first hole having a first inner diameter from the discharge space side surface to a predetermined depth; and a second hole that communicates with the first hole, penetrating up to the second thrust bearing surface, and having a second inner diameter, and wherein the second inner diameter of the second hole is smaller than the outer diameter of the decompression member.

5. The scroll compressor of claim 4, wherein the first inner diameter of the first hole is larger than the second inner diameter of the second hole to form a connection surface between the first hole and the second hole, and the end of the decompression member is supported by the connection surface.

6. The scroll compressor of claim 5, wherein the communication recess formed at the end of the decompression member is in contact with the connection surface to allow the first hole and the second hole to communicate with each other.

7. The scroll compressor of claim 4, wherein the decompression member is positioned on an outer side with respect to the compression chamber in the axial direction.

8. The scroll compressor of claim 1, wherein the decompression member is formed to have a length such that at least a portion thereof overlaps the compression chamber in a radial direction.

9. The scroll compressor of claim 1, wherein one end of the communication hole formed on the second thrust bearing surface is formed at an outer side, relative to an outermost compression chamber.

10. A scroll compressor, comprising:

a casing, an internal space of which is divided into a suction space and a discharge space;

a main frame coupled to the casing;

a non-orbiting scroll coupled to the main frame and having a discharge space side surface included in the discharge space;

an orbiting scroll supported by the main frame in a thrust direction and having a first surface forming a first thrust bearing surface together with the main frame and a second surface forming a second thrust bearing surface together with the non-orbiting scroll the orbiting scroll being engaged with the non-orbiting scroll to form a compression chamber;

a communication hole that penetrates from the discharge space side surface of the non-orbiting scroll to the second thrust bearing surface; and a decompression member inserted into the communication hole, wherein the decompression member includes a communication recess formed at an end of the decompression member adjacent to the second thrust bearing surface, wherein an extending recess that communicates with the communication hole is formed on a high pressure portion side surface of the non-orbiting scroll, the extending recess having a predetermined length, and a cover that covers a portion of the extending recess including a portion at which the extending recess and the communication hole are connected is coupled to the high pressure portion side surface of the non-orbiting scroll.

11. A scroll compressor, comprising:

a casing, an internal space of which is divided into a suction space and a discharge space;

a main frame coupled to the casing;

a non-orbiting scroll coupled to the main frame and having a discharge space side surface included in the discharge space;

an orbiting scroll supported by the main frame in a thrust direction and having a first surface forming a first thrust bearing surface together with the main frame and a second surface forming a second thrust bearing surface together with the non-orbiting scroll, the orbiting scroll being engaged with the non-orbiting scroll to form a compression chamber;

a communication hole that penetrates from the discharge space side surface of the non-orbiting scroll to the second thrust bearing surface;

an extending recess having a predetermined length and sectional area on the discharge space side surface of the non-orbiting scroll, the extending recess communicating with the communication hole; and a cover that covers a portion of the extending recess including a portion at which the extending recess and the communication hole are connected.

12. The scroll compressor of claim 11, wherein a radial sectional area of the extending recess is smaller than or equal to a radial sectional area of the communication hole.

13. A scroll compressor, comprising:

a casing, an internal space of which is divided into a suction space and a discharge space;

a main frame coupled to the casing;

a non-orbiting scroll coupled to the main frame and having a discharge space side surface included in the discharge space;

an orbiting scroll supported by the main frame in a thrust direction and having a first surface forming a first thrust bearing surface together with the main frame and a second surface forming a second thrust bearing surface together with the non-orbiting scroll, the orbiting scroll being engaged with the non-orbiting scroll to form a compression chamber;

a communication hole that penetrates from the discharge space side surface of the non-orbiting scroll to the second thrust bearing surface, wherein the communication hole includes:

a first hole having a first inner diameter from the discharge space side surface to a predetermined depth; and a second hole that communicates with the first hole, penetrating up to the second thrust bearing surface, and having a second inner diameter, wherein the second inner diameter of the second hole is smaller than the first inner diameter of the first hole; and a decompression member inserted into the communication hole, wherein a space is formed between an inner circumferential surface of the communication hole and an outer circumferential surface of the decompression member, and wherein the space penetrates from the discharge space side surface of the non-orbiting scroll to the second thrust bearing surface.

14. The scroll compressor of claim 13, wherein a valve is provided on the discharge space side surface of the non-orbiting scroll, and at least a portion of the valve or a member supporting the valve overlaps the discharge space side end of the decompression member in the axial direction.

15. The scroll compressor of claim 13, wherein an end of the decompression member is supported by a connection surface formed between the first hole and the second hole.

16. The scroll compressor of claim 13, wherein central longitudinal axes of the first hole and the second hole are different.

* * * * *